US007074093B2

(12) United States Patent
Saka et al.

(10) Patent No.: US 7,074,093 B2
(45) Date of Patent: Jul. 11, 2006

(54) SPLICE ABSORBING STRUCTURE FOR MOTOR VEHICLE

(75) Inventors: Yuuji Saka, Yokkaichi (JP); Yukihiro Shirafuji, Yokkaichi (JP); Takeharu Ito, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/953,137

(22) Filed: Sep. 29, 2004

(65) Prior Publication Data

US 2005/0079755 A1 Apr. 14, 2005

(30) Foreign Application Priority Data

Oct. 8, 2003 (JP) ..... 2003-349075

(51) Int. Cl.
*H01R 11/09* (2006.01)

(52) U.S. Cl. ..... 439/724; 439/417

(58) Field of Classification Search ..... 439/724, 439/723, 397, 417, 404, 405, 189, 516, 885
See application file for complete search history.

(56) References Cited

U.S. PATENT DOCUMENTS 4,678,264 A * 7/1987 Bowen et al. ..... 385/89
4,824,394 A * 4/1989 Roath et al. ..... 439/395
5,051,100 A * 9/1991 Kato et al. ..... 439/140
5,664,963 A * 9/1997 Yamamoto et al. ..... 439/409
5,759,053 A * 6/1998 Sugiyama ..... 439/212
5,762,517 A 6/1998 Abe
6,015,312 A * 1/2000 Escane ..... 439/417

FOREIGN PATENT DOCUMENTS

| | | |
|---|---|---|
| JP | 07-263036 | 10/1995 |
| JP | 08-250247 | 9/1996 |
| JP | 09-153380 | 6/1997 |
| JP | 11-154578 | 6/1999 |

* cited by examiner

*Primary Examiner*—Tulsidas C. Patel
*Assistant Examiner*—Phuongchi Nguyen
(74) *Attorney, Agent, or Firm*—Oliff & Berridge, PLC

(57) ABSTRACT

Cables W are spliced to one another by insulation displacement terminals 22 in sub connectors 21A and 21B, when a cable holder 11 that contains ends of a plurality of cables is fitted into containing sections of the sub connector housings 21A and 21B. A tab 22*c* of each insulation displacement terminal 22 is connected to each joint bus bar 24 disposed in a joint connector housing 31. The sub connectors 21A and 21B are interconnected when the sub connectors 21A and 21B are fitted into containing sections of the joint connector housing 31.

13 Claims, 9 Drawing Sheets

SPLICE ABSORBING STRUCTURE FOR MOTOR VEHICLE

CROSS-REFERENCE TO RELATED APPLICATIONS

The entire disclosure of Japanese Patent Application No. 2003-349075 filed on Oct. 8, 2003 including the specification, claims, drawings and summary is incorporated herein by reference in its entirety.

FIELD OF THE INVENTION

This invention relates to a splice absorbing structure for a motor vehicle and, more particularly, to a splice absorbing structure where splices between cables of sub harnesses can be flexibly adapted to various circuit connection configurations.

BACKGROUND OF THE INVENTION

Joint connectors have been utilized in order to splice cables to be used in a common circuit system in a wire harness. FIG. 9 shows a conventional joint connector 1. A spliced bus bar 2, adapted to various connection configurations, is mounted in a housing 1*a*. A mating connector 3 is engaged with the joint connector 1 and includes a female housing 3*b* with a plurality of cavities 3*a* formed in multiple stages. A female terminal 4 is to be inserted into one of the cavities 3*a*. The female terminal 4 is crimped on an end of each cable W of each sub harness, which is assembled in another step. The female terminal 4 is regularly inserted into the female housing 3*b* as an after-insertion terminal in a step of binding the respective sub harnesses. When the female housing 3*b* is fitted into the housing 1*a* of the joint connector 1, the respective terminals 4 in the female housing 3*b* are interconnected in the respective common circuits through the bus bar 2.

A connector having the same construction as that of the above joint connector 1 is disclosed in Japanese Patent Public Disclosure No. HEI 8-250247 (1996).

Generally, in the general joint connector 1 described above, it is necessary to insert the respective female terminals 4, crimped on the respective ends of the sub harness, into the common female housing 3*b* in order to interconnect the circuits across different sub harnesses. In a step of assembling the sub harnesses, an after-insertion female terminal 4 that has not yet been inserted in the housing may appear. This will make subsequent work complicated and may give rise to damage of the female terminal 4 during transportation of the sub harnesses. Since the female terminal 4 is a complex pressed product and a lance structure is required for engaging the female terminal 4 with the female housing 3*b*, costs of parts will be increased. Furthermore, since an end treatment, such as stripping a sheath of a cable W or the like, and a crimping step on the terminal are required, man-hour work will be increased.

SUMMARY OF THE INVENTION

In view of the above problems, the present invention includes a splice absorbing structure for a motor vehicle. The structure can flexibly comply with alterations to a number of to be spliced cables and with circuit arrangement without requiring an end treatment on to be spliced cables. Crimping work on terminals can be completed without providing an after-insertion terminal in a sub harness in the case of using a joint connector housing that contains a plurality of sub connectors.

The present invention provides a splice absorbing structure for a motor vehicle that comprise a cable holder to contain ends of a plurality of cables in an aligned state and a sub connector. In the sub connector, insulation displacement terminals have a plurality of insulation displacement blades. The blades are previously contained in an aligned state. The sub connector includes a cable holder that contains a section adapted to accommodate the cable holder. The cables are connected to the insulation displacement blades when the cable holder is fitted into the cable holder containing section.

According to the above construction, since it is not necessary to previously connect terminals to the ends of the to be spliced cables and the ends are merely contained in the cable holder in the aligned state, it is possible to simplify an assembly step of the sub harnesses. The cables in the cable holder are spliced with one another through the insulation displacement terminals in a step of containing the cable holder in the sub connector.

The splice absorbing structure for a motor vehicle further comprises a joint connector housing. In the joint connector housing, a plurality of sub connector containing sections are provided in parallel to one another. A joint bus bar is contained in the joint connector housing. The bus bar has a plurality of tuning fork terminal portions that project toward a bottom surface of the sub connector containing section. A tab is provided on each of the insulation displacement terminals in the sub connector containing section. The tab is connected to each of the tuning fork terminal portions of the joint bus bar when the sub connector is fitted into the sub connector containing section.

According to the above construction, in order to interconnect the cables contained in one cable holder in the aligned state and other cables contained in the other cable holder, they can be spliced through the joint bus bar when the sub connector accommodating the cable holder is contained in the joint connector housing. Thus, since it is possible to optionally splice the cables in the different cable holders through the joint bus bar, it is possible to contain in the cable holder all of the cables to be spliced in the respective sub harnesses. This enables a completed sub harness to be formed in the step of assembling the sub harnesses.

More particularly, a linked member, whose elements are linked through carriers, is used as the insulation displacement terminals contained in the sub connector. Adjacent insulation displacement terminals include a first insulation displacement terminal unit and a second insulation displacement unit. The first insulation displacement unit has insulation displacement blades formed on an end of a short stem portion. The second insulation displacement terminal unit has insulation displacement blades formed on an end of a long stem portion. The first and second insulation displacement terminal units are alternately disposed. The linked member is used by cutting off the carriers in accordance with a circuit configuration. The tabs of the respective insulation displacement terminals extend from the carrier by the same length.

According to the above construction, since the insulation displacement terminals that splice the cables in the cable holder are formed into the linked member with the carriers, it is possible to optionally set connection configurations between the cables by changing the cutting positions on the linked member. Also, since the first and second insulation displacement terminal units, which includes the insulation displacement blades to be press-contacted with the cables, are disposed alternatively on the short and long stem portions, the adjacent insulation displacement terminal units do not interfere with each other. Thus, they can be fully adapted to the narrow pitches between the cables.

Also, the cable holder includes a body and a lid joined to the body through a hinge. The body has a plurality of juxtaposed cable fitting grooves. Each of the cable fitting grooves includes cable latching portions to hold the cable therein. The lid has a detection window to detect an end of the cable and a protrusion to press the cable. One of the body or the lid includes an insertion slot to pass the insulation displacement blades into the cable fitting groove. The lid is closed onto and locked to the body where the cables are received in the cable fitting grooves. Only the ends of plural cables are contained in the cable holder.

According to the above construction, since the cable holder includes the body and the lid coupled to the body through the hinge, it is possible to dispose the ends of the cables to be spliced in the cable fitting grooves when the lid is opened. Since the cable latching portions are provided in the cable fitting grooves, it is possible to fix the cables disposed in the cable fitting grooves at the given positions. Furthermore, the cable pressing protrusions are provided on the lid. The cable pressing protrusions bite into the cables in the cable fitting grooves. Thus, the pressing protrusions restrain the cables from shifting in direction or coming out of the cable holder. Thus, it is possible to confirm whether the cables are disposed at the regular positions before hand by detecting the ends of the cables in the cable fitting grooves through the detection window in the lid. Consequently, it is possible to prevent failure of the connection between the cables and the insulation displacement blades due to lack of cable insertion.

The sub connector is formed into a box-like configuration with openings at the opposite ends. The sub connector includes a housing on an intermediate part with a partition. The cable holder containing section is defined in a space at one side of the partition. A sidewall of the cable holder containing section is cut off to define an insertion opening for the cable holder. The partition is provided with a terminal hole. A containing chamber, for the tuning fork terminal portions of the joint bus bar, is defined in a space at the other side of the partition. The insulation displacement terminals are previously contained in the sub connector. Ends of the tabs of the terminals pass the terminal hole in the partition and project into the containing chamber for the tuning fork terminal portions. The insulation displacement blades of the terminals are bent along the partition. The insulation displacement blades are bent from the short and long stem portions toward the insertion opening of the cable holder.

According to the above construction, it is possible to press-contact the insulation displacement blades of the insulation displacement terminal with the desired cables in the cable holder to simultaneously splice the desired cables. The cable holder is accommodated in the cable holder containing section in the upper part of the sub connector. Also, since the tabs of the insulation displacement terminals project into the containing chamber, for the tuning fork terminal portions in the lower part of the sub connector, the insulation displacement terminals are further interconnected when the tuning fork terminal portions are received in the containing chamber.

The joint connector housing has a partition standing on a bottom wall in the interior and sub connector containing sections each provided with an upper opening for containing the sub connector. A continuous base portion of the joint bus bar is secured to the bottom wall. The tuning fork terminal portions stand on the continuous base portion at a given distance spaced away from each other and project toward the sub connector containing sections. The tuning fork terminal portions project into the sub connectors to be connected to the tabs, when the sub connectors are fitted into the sub connector containing sections.

Thus, the tuning fork terminal portions contact with the tabs of the insulation displacement terminals of the sub connector. Simultaneously, the sub connector is fitted in the connector containing section. Accordingly, it is possible to interconnect the desired insulation displacement terminals in the cable holders through the joint bus bar.

In the present invention, it is possible to splice the cables contained in the cable holder through the insulation displacement terminals without requiring stripping of the cable ends and crimping the insulation displacement terminal. Accordingly, it is possible to simplify the splicing step and the structure itself in comparison with prior art junction boxes that utilize the joint connector. Thus, it is possible to reduce costs of parts and production.

Also, it is possible to splice the cables in another cable holder with one another through the joint bus bar contained in the joint connector housing. Accordingly, the present invention can be flexibly adapted to various splice circuit arrangements by a combination of the insulation displacement terminals and the joint bus bars. Thus, the sub harness, with the to be spliced cables can be completed in the respective steps of producing the sub harness and no after-insertion cable appears in the splicing step.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
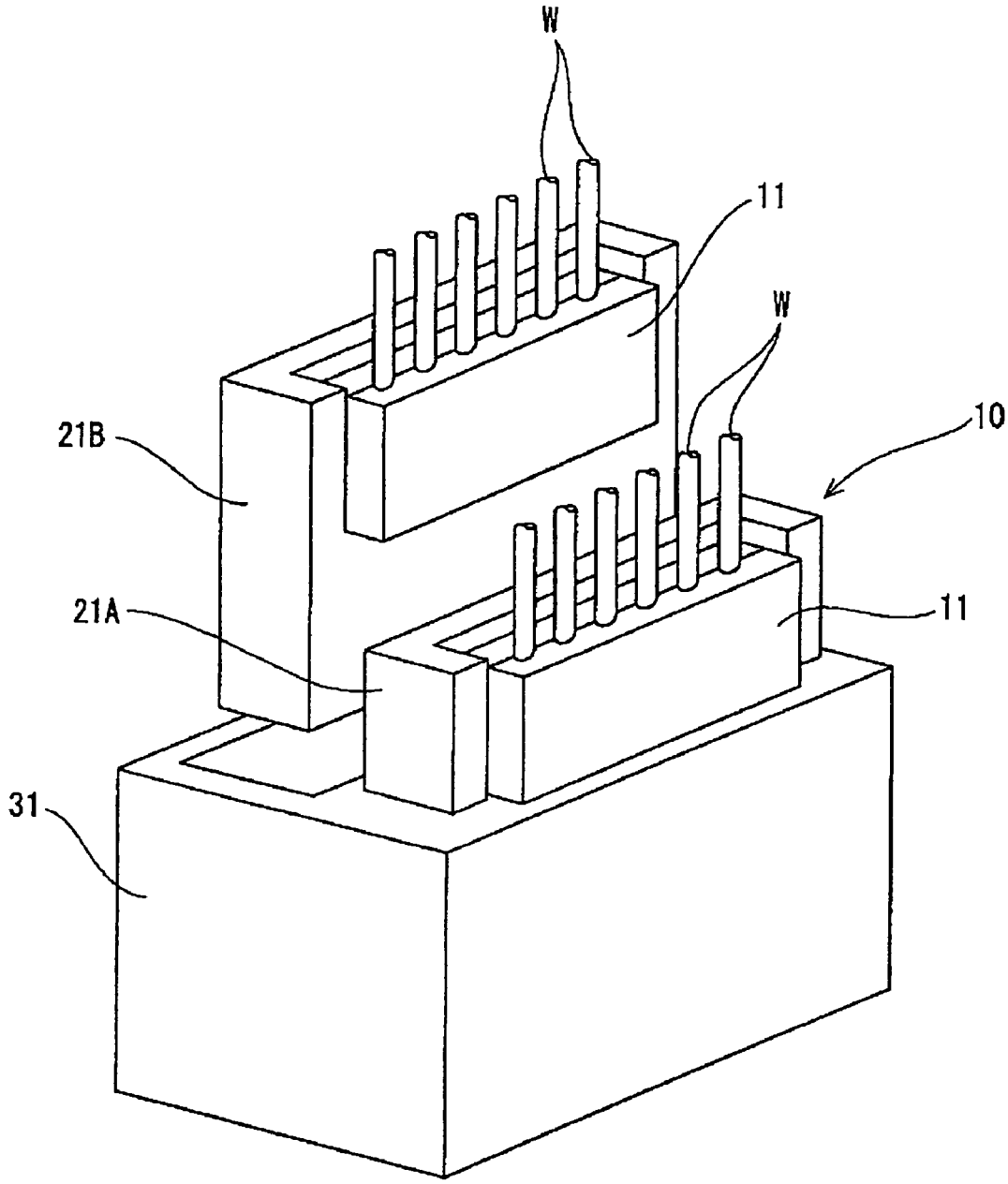
FIG. 1 is a perspective view of a splice absorbing junction box for a motor vehicle in accordance with the present invention.
Figure 2A:
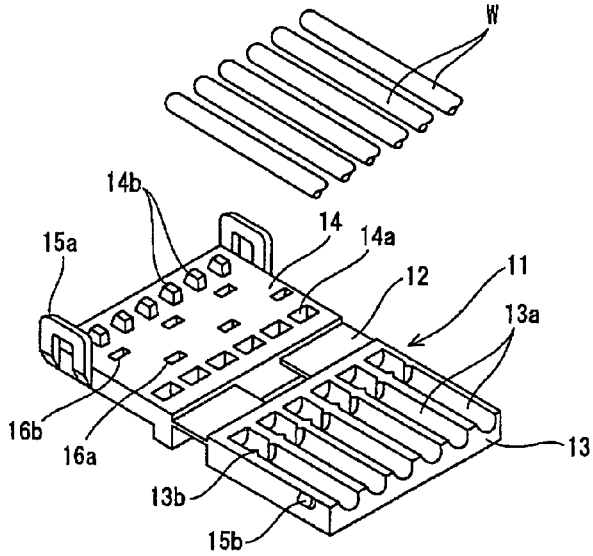
FIG. 2A is a perspective view of a cable holder before the cable holder receives cables.
Figure 2B:
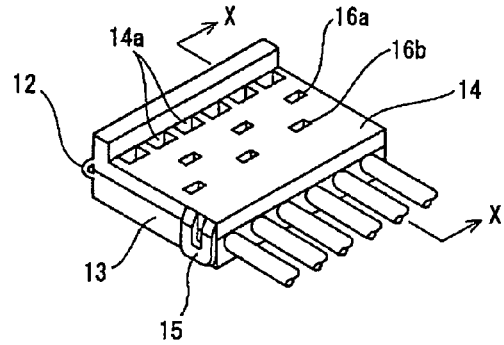
FIG. 2B is a perspective view of the cable holder after the cable holder receives the cables.
Figure 2C:
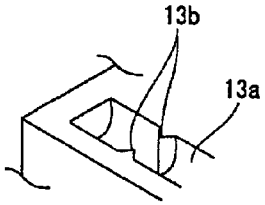
FIG. 2C is an enlarged perspective view of a main part of a cable-fitting groove.
Figure 2D:
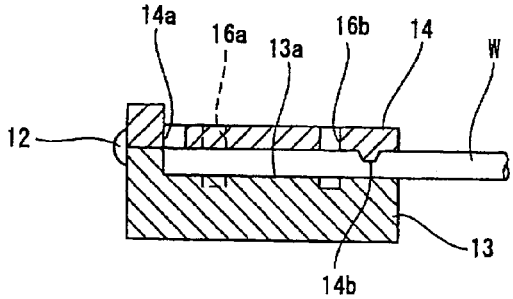
FIG. 2D is a cross sectional view of the cable holder taken along a line X—X in FIG. 2B.

The following description of the preferred embodiment(s) is merely exemplary in nature and is in no way intended to limit the invention, its application, or uses.

Referring now to the drawings, an embodiment of a splice absorbing structure for a motor vehicle in accordance with the present invention will be described.

As shown in FIGS. 1 to 5, a motor vehicle splice absorbing junction box 10 includes a cable holder 11, that accommodates cables W to be spliced in a juxtaposed manner, sub connectors 21A and 21B, that accommodates the cable holder 11, and a joint connector housing 31, that accommodates the plural sub connectors 21A and 21B parallel to one another.

The cable holder 11, as shown in FIGS. 2A to 2D, is made of a synthetic resin material. The cable holder 11 includes a body 13 and a lid 14 pivotally coupled to each other through hinges 12. The body 13 includes a plurality of juxtaposed cable fitting grooves 13*a* that receive ends of the plural cables W positioned parallel to one another. Each groove 13*a* is formed into a recess having a curvature corresponding to the outer diameter of the cable W. The groove 13*a* is provided near a proximal end with cable latching portions 13*b*. Cable latching portions 13*b* project from the opposed sidewalls of the groove 13*a* toward the centerline. Since the cable latching portions 13*b* narrow a part of the cable fitting groove 13*a*, the cable latching portions 13*b* bite into the cable W when the cable W is inserted into the groove 13*a*. This positions and latches the cable W in the groove 13*a*.

The lid 14 includes a detection window 14*a* in a position corresponding to the proximal end of each cable fitting groove 13*a*. Thus, it is possible to confirm whether the cable W is inserted into a given longitudinal position in the groove 13*a*, when the end of the cable W is found through the detection window 14*a*. Such confirmation of the position of the cable W is carried out in order to ensure a connection between the cable and an insulation displacement terminal 22.

The lid 14 includes, on the end opposite from the detection windows 14*a*, cable pressing protrusions 14*b*. The cable W is prevented from coming out from the cable holder 11 when the cable pressing protrusion 14*b* forcedly pushes the cable W in the cable fitting groove 13*a*. A lock mechanism 15 is provided on the body 13 and lid 14. The lock mechanism 15 includes arms 15*a* on the opposite sides of the lid 14 at the end opposing from the hinges 12. Lock pawls 15*b* are on the opposite sides of the body 13 at the end opposing the hinges 12. The arms 15*a* resiliently engage the lock pawls 15*b* when the lid 14 is closed on the body 13. The lid 14 has insulation slots 16*a* and 16*b* in the portion between the detection windows 14*a* and the cable pressing protrusions 14*b*. The insertion slots 16*a* and 16*b* are arranged in a staggered manner at positions corresponding to the arrangement of the cables W. The insertion slots 16*a* and 16*b* receive insulation displacement blades 22*a* and 22*b* of the insulation displacement terminals 22, described later, from the outside into the cable fitting grooves 13*a*.

Figure 3A:
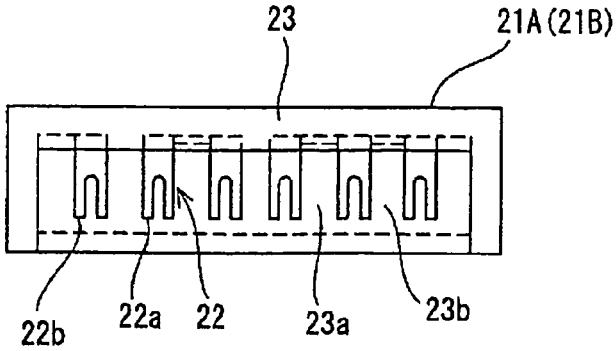
FIG. 3A is a plan view of a sub connector.
Figure 3B:
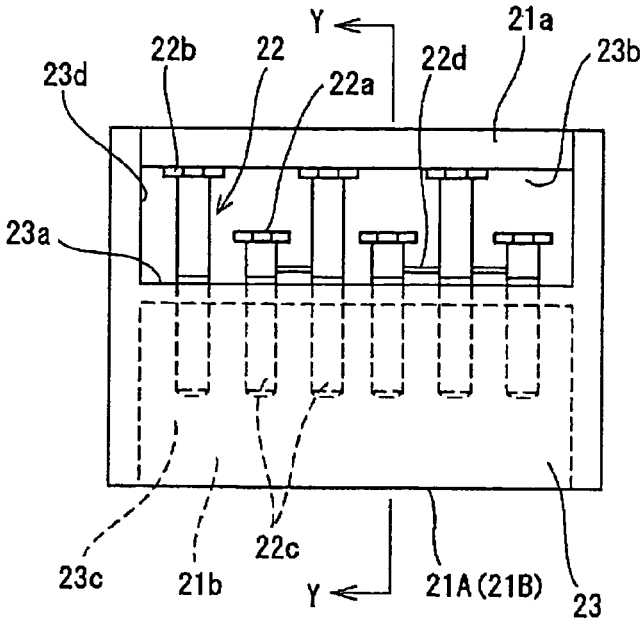
FIG. 3B is a front elevation view of the sub connector.
Figure 3C:
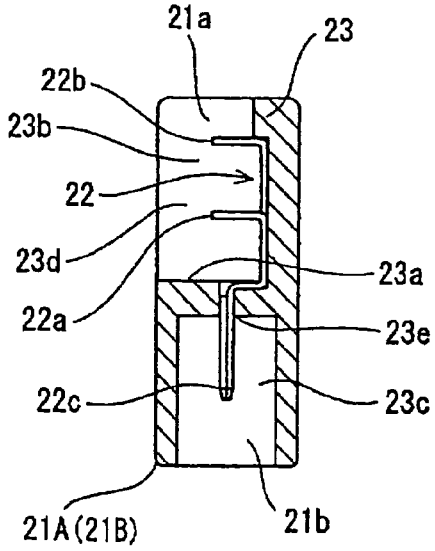
FIG. 3C is a cross sectional view of the sub connector taken along a line Y—Y in FIG. 3B.

As shown in FIGS. 3A to 3C, the sub connectors 21A and 21B are made of a synthetic resin material. The sub connectors 21A and 21B include a box-like housing 23 with openings 21*a* and 21*b* at the upper and lower ends and insulation displacement terminals 22 that have been previously provided in the housing 23A partition 23*a* is provided on an intermediate part of the housing 23. A cable holder containing section 23*b* is defined in an upper space above the partition 23*a*. A containing chamber 23*c* is defined in a lower space below the partition 23*a*. The containing chamber 23*c* accommodates tuning fork terminal portions 24*a* of a joint bus bar 24. The cable holder containing section 23*b* is cut off at a sidewall to form a cable holder insertion opening 23*d* that can laterally receive the cable holder 11.

Figure 4A:
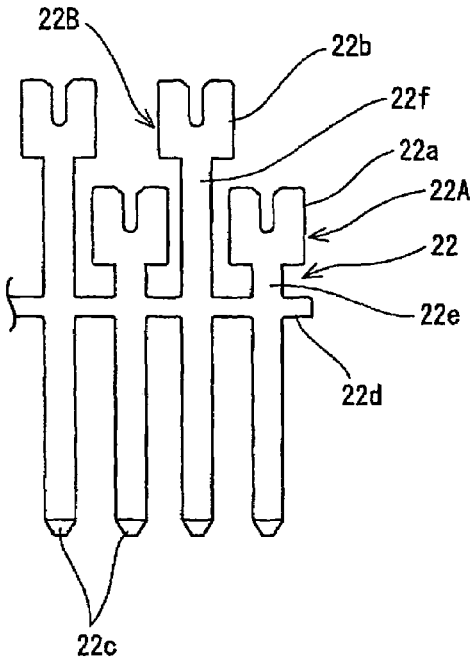
FIG. 4A is a plan view of an insulation displacement terminal after a punching process is finished.
Figure 4B:
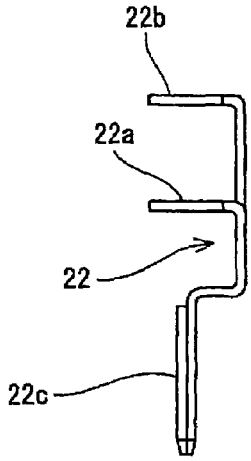
FIG. 4B is a side elevation view of the terminal after a bending process is finished.
Figure 4C:
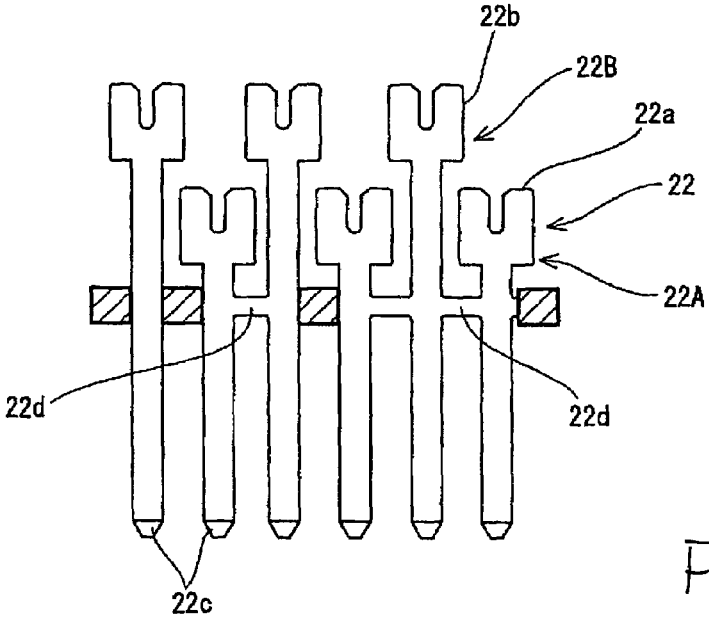
FIG. 4C is a plan view of the terminal after carriers are cut off.

As shown in FIG. 4A, the insulation displacement terminals 22, to be accommodated in the sub connectors 21A and 21B, are formed into a linked and juxtaposed configuration by punching a conductive metallic plate. Each insulation displacement terminal 22 has insulation displacement blades 22*a* and 22*b* at one end and a tab 22*c* at the other end. The insulation displacement terminals 22 are made of a linked member whose elements are joined to one another through carriers 22*d*.

The insulation displacement terminal 22 includes a first insulation displacement terminal unit 22A having insulation displacement blades 22*a* on a short stem portion 22*e* to receive the cable W at its distal end. A second insulation displacement terminal unit 22B has insulation displacement blades 22*b* on a long stem portion 22*f* to receive the cable W at its distal end. The first and second insulation displacement terminal units 22A and 22B are alternately arranged on the linked member. Since the adjacent first and second insulation displacement terminal units 22A and 22B are alternately arranged in the longitudinal direction on the linked member, the adjacent terminal units 22A and 22B do not interfere with each other even if a pitch between the terminal units is narrowed. Thus, they are adapted to a narrow pitch of cables W. On the other hand, the tabs 22*c* extend from the carriers 22*d* by the same length. The insulation displacement terminal 22 can splice the desired cables W to one another when each of the insulation displacement blades 22*a* and 22*b* press-contact with the cables W in the cable holder 11. The carriers 22*d*, interconnecting the respective insulation displacement blades 22*a* and 22*b*, are cut off at the positions shown by the hatching in FIG. 4C in accordance with a desired circuit design.

The insulation displacement terminal 22 is punched out in the manner described above as shown in FIG. 4*b*. The insulation displacement terminal 22 is bent near a proximal end of the tab 22*c* in a step-like shape. The first and second insulation displacement terminal units 22A and 22B are bent in a direction perpendicular to the tabs 22*c*. A distance between the insulation displacement blades 22*a* and 22*b* corresponds to a distance between the insertion slots 16*a* and 16*b* in the cable holder 11.

As shown in FIG. 3C, the insulation displacement terminal 22, bent in the manner described above inserts the tab 22*c* into the containing chamber 23*c*. The distal end of the tab 22*c* pass through a terminal hole 23*e* in the partition 23*a*. The first and second insulation displacement terminal units 22A and 22B are bent along the upper surface of the partition 23*a*. The insulation displacement blades 22*a* and 22*b* formed on the distal ends of the short and long stem portions 22*e* and 22*f* are bent toward the insertion opening 23*d* for the cable holder. When the tab 22*c* of the insulation displacement terminal 22 is pushed into the terminal hole 23*e* in the partition 23*a*, the terminal 22 is temporarily secured to the housing 23. When the cable holder 11 is fitted into the cable holder containing section 23*b*, the insulation displacement terminal 22 is positively secured to the housing 23.

Figure 5:
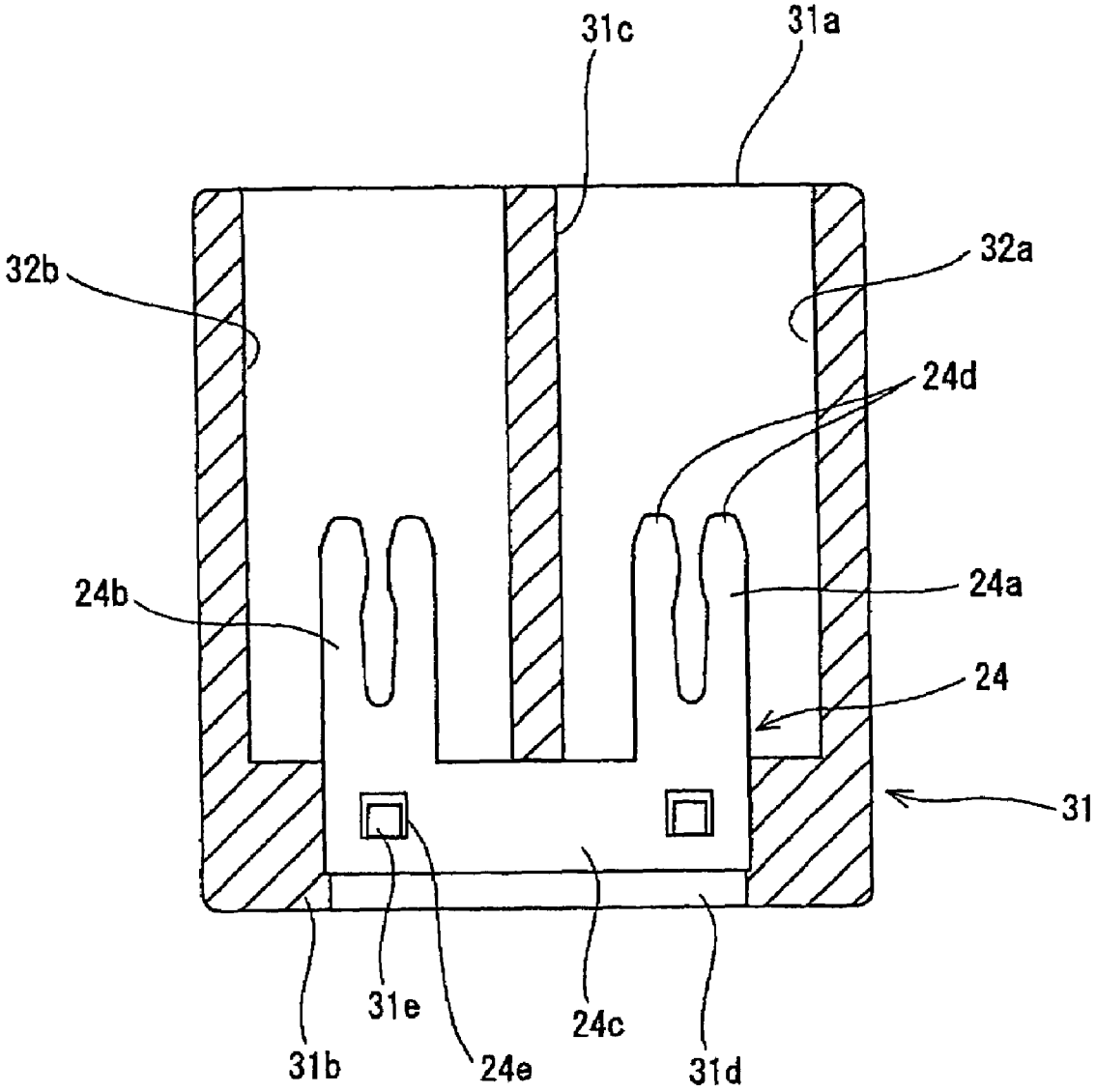
FIG. 5 is a sectional view of a joint connector housing.

As shown in FIG. 5, the joint connector housing 31 is made of a synthetic resin material. The joint connector housing 31 is formed into a box-like configuration with an upper opening 31*a* and bottom wall 31*b*. A partition 31*c* extends from a central part of the bottom wall 31*b* in a lateral direction toward the upper opening 31*a*. The partition 31*c* defines sub connector containing sections 32*a* and 32*b* in the joint connector housing 31. The sub connector containing sections 32*a* and 32*b* accommodate the sub connectors 21A and 21B in parallel to each other in the housing 31.

As shown in FIG. 5, a conductive metallic plate forms a joint bus bar 24 that is previously contained in the joint connector housing 31. The joint bus bar 24 is provided with tuning fork terminal portions 24*a* and 24*b*. The tuning fork terminal portions 24*a* and 24*b* extend upward from the opposite ends of a continuous base portion 24*c* in the vertical direction. A distance between the pair of tuning fork terminal portions 24*a* and 24*b* is set to a corresponding pitch between two sub connectors 21A and 21B (see FIG. 1) accommodated in the sub connector containing sections 32*a* and 32*b*. The tuning fork terminal portions 24*a* and 24*b* extend into the corresponding sub connector containing sections 32*a* and 32*b*, respectively. The joint bus bar 24 is secured to the joint connector housing 31 by engaging a lock protrusion 31*e* on the terminal hole 31*d* in the bottom wall 31*b* of the joint connector housing 31. A lock hole 24*e* in the continuous base portion 24*c* couples the lock protrusion 31*e* so that the joint bus bar 24 is disposed at a position corresponding to the tabs 22*c* of the insulation displacement terminals 22 contained in the two sub connectors 21A and 21B. The tuning fork terminal portions 24*a* and 24*b* are electrically coupled to the insulation displacement terminals 22 when the tabs 22*c* of the terminals 22 are pushed into a space between a pair of contact pieces 24*d* spaced away from each other by a desired distance.

Next, an operation of the splice absorbing junction box 10 for a motor vehicle constructed above will be explained below.

Firstly, as shown in FIGS. 2A to 2D, ends of cables W in one sub harness and/or ends of cables W to be spliced to the cables W in the other sub harness are inserted into the cable fitting grooves 13*a* in the cable holder 11. At this time, since the respective cables W are nipped in the cable latching portions 13*b*, the cables W are positioned in the cable fitting grooves 13*a*. The lid 14 is closed on the body 13 and the lock mechanism 15 maintains the cable holder 11 in the closed position. Thus, the respective cables W are prevented from coming out from the cable holder 11 when the cable pressing protrusions 14*b* on the lid 14 bite into the respective cables W. Also, when the ends of the respective cables W are found through the detection windows 14*a* in the lid 14, it is possible to confirm whether the respective cables W are supported at the given positions in the cable holder 11. If the ends of the respective cables W are not found through the detection windows 14*a*, the inserted positions of the cables W are adjusted again.

Figure 6:
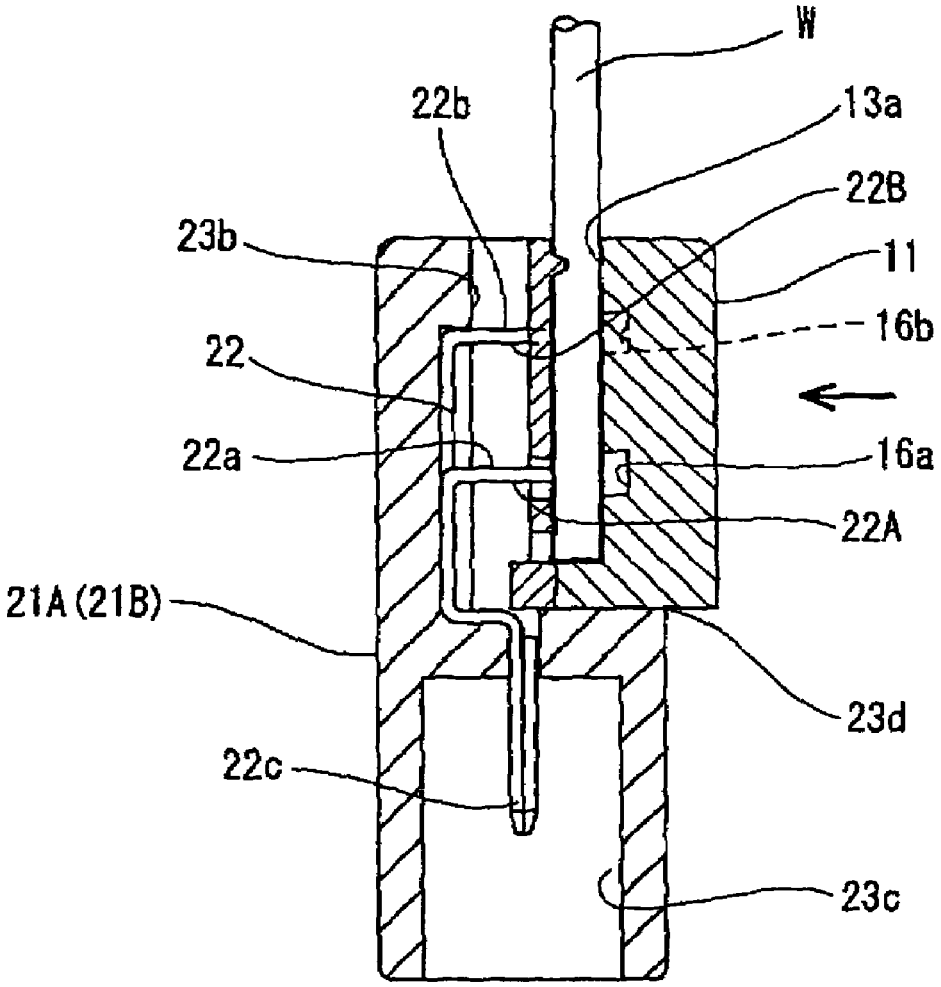
FIG. 6 is a sectional view of the sub connector to which the cable holder is attached.
Figure 7:
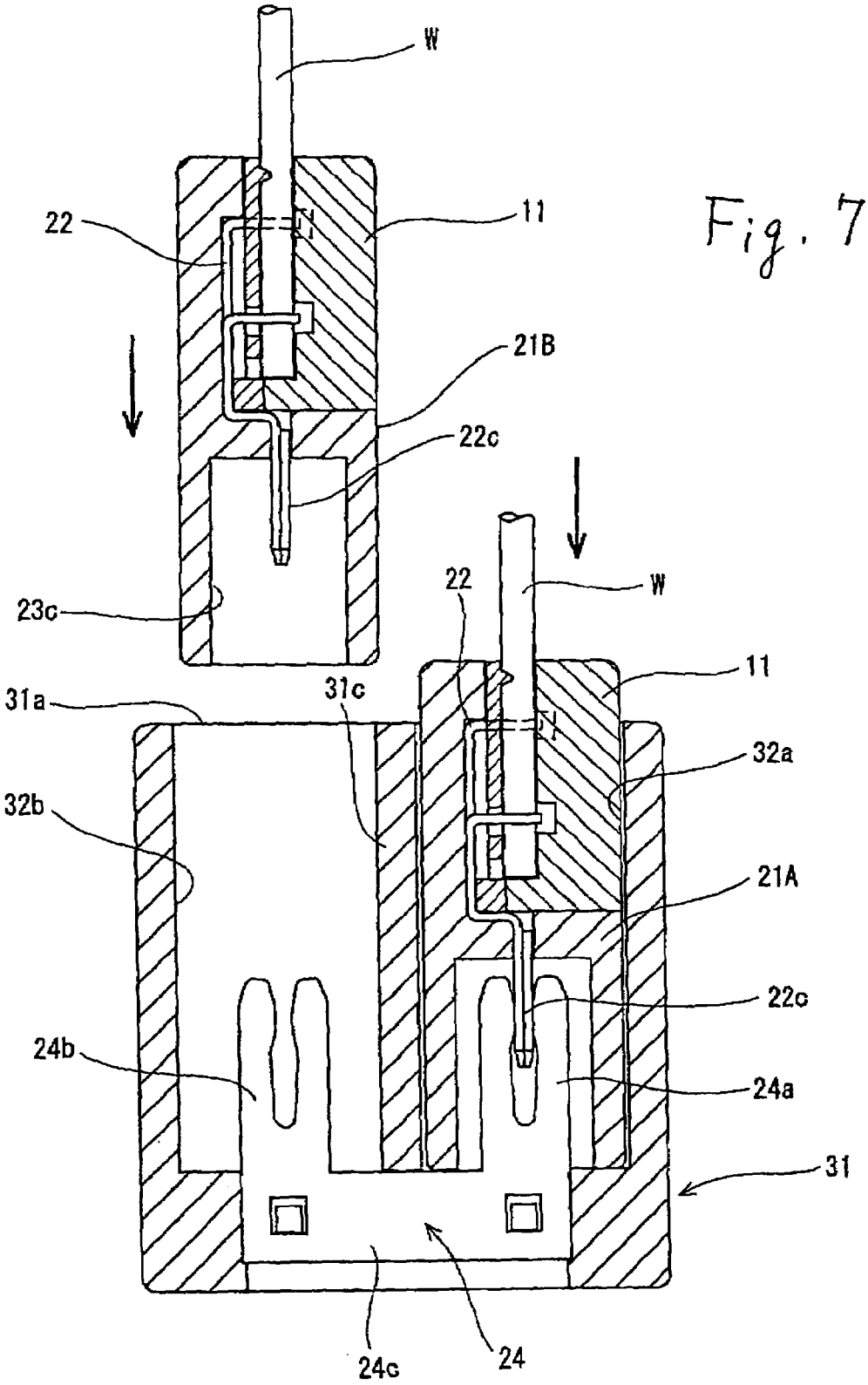
FIG. 7 is a sectional view of the joint connector housing to which the sub connectors are attached.

Turning to FIGS. 6 and 7, the cable holder 11, containing the cables W, is inserted laterally into the opening 23*d* in each of the sub connectors 21A and 21B to engage the cable holder 11 with the cable holder containing section 23*b*. The insulation displacement blades 22*a* and 22*b*, of the first and second insulation displacement terminal units 22A and 22B disposed in the cable holder containing sections 23*b*, are inserted through the insertion slots 16*a* and 16*b* in the cable holder 11 into the cable fitting grooves 13*a*. The cable holder 11 surely fixes the insulation displacement terminals 22 in the sub connectors 21A and 21B. In connection with the above operation, the respective insulation displacement blades 22*a* and 22*b* receive core wires of the cable W while entering the opposite sides of a sheath of each cable W. The positions of splicing the plural cables W can be adapted to various patterns by cutting off, previously, the carries 22*d* of the insulation displacement terminal 22 in accordance with the circuit arrangement.

The two sub connectors 21A and 21B are inserted into and fitted in the sub connector containing sections 32*a* and 32*b* in the joint connector housing 31 through the upper opening 31*a*. Thus, the tabs 22*c*, projecting into the containing chamber 23*c* in the sub connectors 21A and 21B, are connected to the tuning fork terminal portions 24*a* and 24*b* of the joint bus bar 24. In connection with the above operation, the tabs 22*c* of the insulation displacement terminals 22 in the two sub connectors 21A and 21B are connected to each other through the continuous base portion 24*c* of the joint bus bar 24.

Figure 8A:
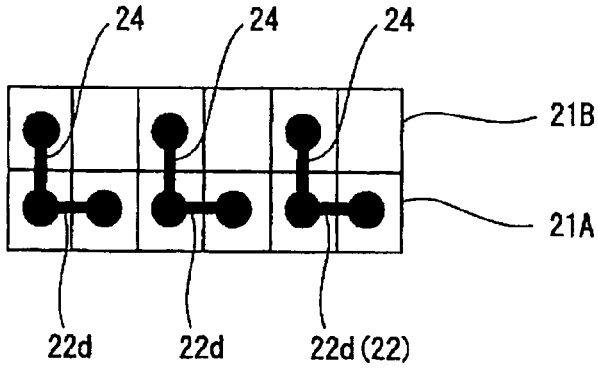
FIGS. 8A to 8C are schematic plan views of the joint connectors, illustrating arrangements of the terminals and bus bars between the joint connectors.
Figure 8B:
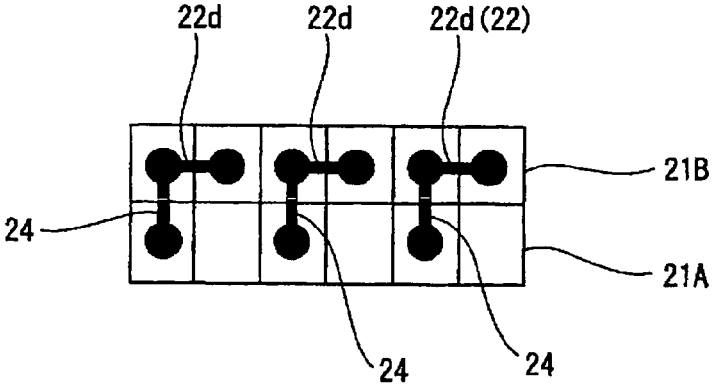
Figure 8C:
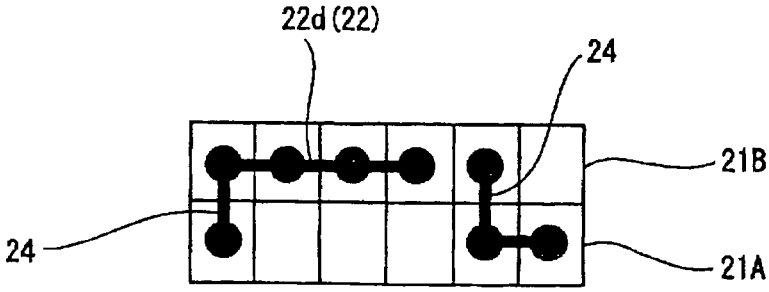
Figure 9:
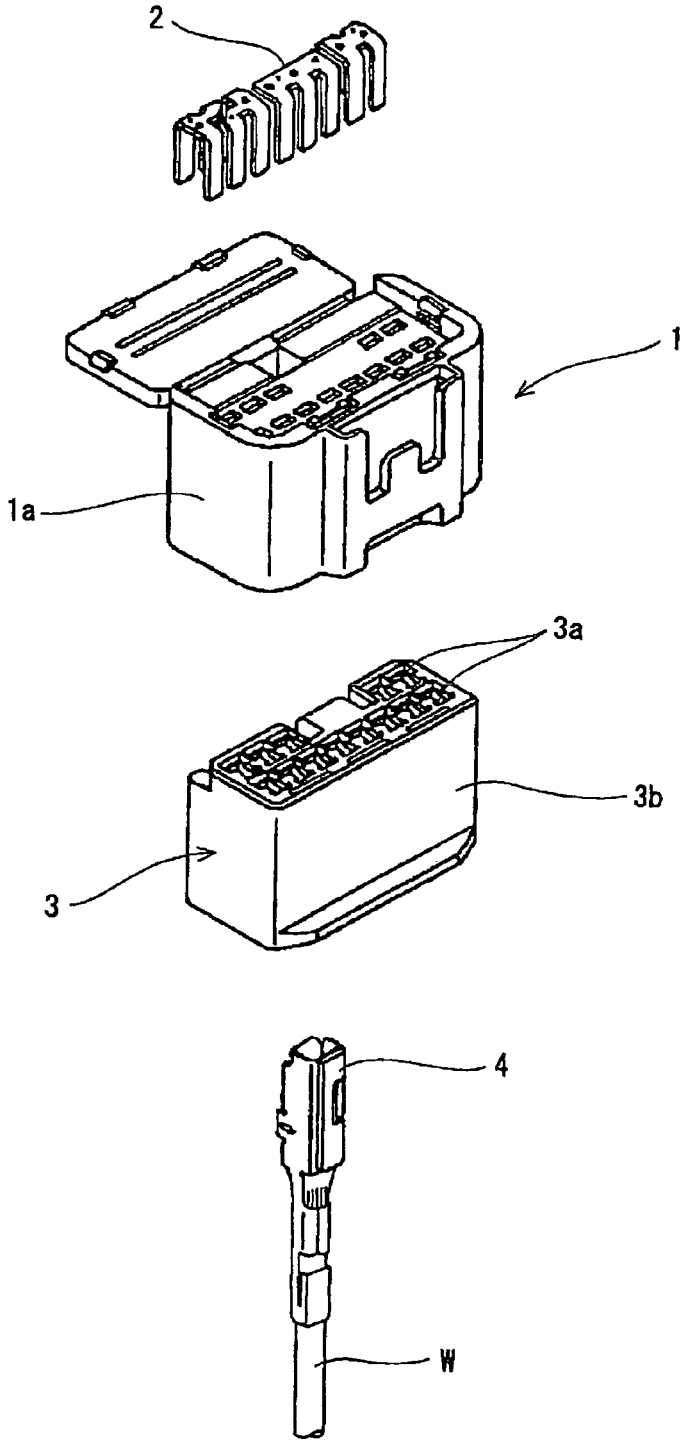
Fig. 9 (Prior Art)
FIG. 9 is an exploded perspective view of a conventional junction box.

The splice between the cables W in the cable holder 11, by using the insulation displacement terminal 22, and the splice between the cables W in the different sub connectors 21A and 21B, by using the joint bus bar 24 and the insulation displacement terminal 22, can be set in various manners by altering the arrangement of the insulation displacement terminal 22 and joint bus bar 24. For example, FIGS. 8A to 8C show various splice features between the respective cables W in the sub connectors 21A and 21B. That is, a horizontal splice in the respective sub connectors 21A and 21B in the drawings is effected by the carriers 22*d* of the insulation displacement terminal 22. A vertical splice in the respective sub connectors 21A and 21B in the drawings is effected by the joint bus bar 24. In FIGS. 8A and 8B, three pairs of the insulation displacement terminals 22 are used coupling two tabs 22*c*. The joint bus bars 24 are alternately disposed at three positions. In FIG. 8C, the insulation displacement terminals 22 coupling four tabs 22*c* and two tabs 22*c* are used in the sub connectors 21A and 21B individually. Two joint bus bars 24 splice the cables W between the sub connectors 21A and 21B at two positions.

Thus, it is possible to adapt the splice absorbing junction box to various splice circuit arrangements by altering the arrangement of the insulation displacement terminal 22, the joint bus bar 24 and the coupling parts of the carriers 22*d* in the insulation displacement terminal 22. Since the connection between the sub connectors 21A and 21B can be optionally realized, it is possible to complete the cable W to be contained in the cable holder 11 in the step of producing the respective sub harnesses. Thus, no after-insertion cable needs to be inserted in another connector during a splicing step. Since the splice between the respective cables W is carried out by the insulation displacement terminal 22, in the step of accommodating the cable holder 11 in the cable holder containing section 23*b* in the sub connectors 21A and 21B, stripping cable ends and crimping of terminals are not required, thereby simplifying the process.

Although two sub connectors 21A and 21B are contained in the joint connector housing 31 in the above embodiment, more than three sub connectors can be interconnected by increasing the sub connector containing sections 32*a* and 32*b*. Also, although the insertion slots 16*a* and 16*b* for the insulation displacement blades 22*a* and 22*b* are provided in the lid 14, the insertion slits 16*a* and 16*b* may be provided in the body 13 in association with the fitting direction of the cable holder 11 toward the sub connectors 21A and 21B. In cases where the cable holder 11 is incompletely fitted in the cable holder containing section 23*b* in the sub connectors 21A or 21B, it may be possible to detect a half-fitting state (see FIG. 1) of the cable holder 11. This may be accomplished by constructing the sub connectors 21A and 21B that cannot engage the sub connector containing sections 32*a* and 32*b* in the joint connector housing 31.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A splice absorbing structure for a motor vehicle comprising:

a cable holder for containing ends of a plurality of cables in an aligned state, the cable holder including a body and a lid, and a sub connector having insulation displacement terminals having a plurality of insulation displacement blades in an aligned state, said sub connector including a cable holder containing section adapted to accommodate said cable holder, said cables being connected to said insulation displacement blades when said cable holder is fitted into said cable holder containing section, and the body or the lid including an insertion slot for passing said insulation displacement blades.

2. A splice absorbing structure for a motor vehicle according to claim 1, wherein a linked member having elements linked through carriers is used as said insulation displacement terminals contained in said sub connector, adjacent insulation displacement terminals include a first insulation displacement terminal unit in which insulation displacement blades are formed on an end of a short stem portion and a second insulation displacement terminal unit in which insulation displacement blades are formed on an end of a long stem portion, said first and second insulation displacement terminal units being alternately disposed, and said linked member is used by cutting off said carriers in accordance with a circuit configuration.

3. A splice absorbing structure for a motor vehicle according to claim 1, wherein the body and the lid are joined through a hinge, said body includes a plurality of juxtaposed cable fitting grooves, each of said cable fitting grooves includes cable latching portions for holding said cable, said lid includes a detection window for detecting an end of said cable and a protrusion for pressing said cable, said insulation displacement blades passing through said insertion slot into said cable fitting grooves; and wherein said lid is closed onto and locked to said body in which said cables are received in said cable fitting grooves and only the ends of plural cables are contained in said cable holder.

4. A splice absorbing structure for a motor vehicle according to claim 1, further comprising a joint connector housing having a plurality of sub connector containing sections in parallel to one another, a joint bus bar having a plurality of terminal portions that project toward a bottom surface of said sub connector containing section, and a tab on each of said insulation displacement terminals in said sub connector containing section is connected to a respective one of said terminal portions of said joint bus bar when said sub connector is fitted into said sub connector containing section.

5. A splice absorbing structure for a motor vehicle according to claim 4, wherein the terminal portions are forked terminal portions.

6. A splice absorbing structure for a motor vehicle according to claim 1, wherein said sub connector is formed into a box-like configuration having openings at opposite ends and includes a housing provided on an intermediate part with a partition, said cable holder containing section is defined in a space at one side of said partition, a sidewall of said cable holder containing section is open to define an insertion opening for said cable holder, said partition includes a terminal hole, a containing chamber for terminal portions of joint bus bar is defined in a space at the other side of said partition; and ends of said terminals pass said terminal hole in said partition and project into said containing chamber for said terminal portions, said insulation displacement blades of said terminals are bent along said partition, said insulation displacement blades are bent short and long stem toward said insertion opening for said cable holder.

7. A splice absorbing structure for a motor vehicle according to claim 6, wherein the terminal portions are forked terminal portions.

8. A splice absorbing structure for a motor vehicle according to claim 1, further comprising (a) a joint connector housing that has a partition standing on a bottom wall in the interior and sub connector containing sections each including an upper opening for containing said sub connector, and (b) a joint bus bar having a plurality of terminal portions, wherein a continuous base portion of said joint bus bar is secured to said bottom wall, said terminal portions stand on said continuous base portion at a given distance spaced away from each other and project toward said sub connector containing sections; and wherein said terminal portions project into said sub connectors so as to be connected to said terminals when said sub connectors are fitted into said sub connector containing sections.

9. A splice absorbing structure for a motor vehicle according to claim 8, wherein the terminal portions are forked terminal portions.

10. A splice absorbing structure for a motor vehicle comprising:

a cable holder for containing ends of a plurality of cables in an aligned state; and a sub connector having insulation displacement terminals having a plurality of insulation displacement blades in an aligned state, said sub connector including a cable holder containing section adapted to accommodate said cable holder, said cables being connected to said insulation displacement blades when said cable holder is fitted into said cable holder containing section, wherein said sub connector is formed into a box-like configuration having openings at opposite ends and includes a housing provided on an intermediate part with a partition, said cable holder containing section is defined in a space at one side of said partition, a sidewall of said cable holder containing section is open to define an insertion opening for said cable holder, said partition includes a terminal hole, a containing chamber for terminal portions of a joint bus bar is defined in a space at the other side of said partition; and ends of said terminals pass said terminal hole in said partition and project into said containing chamber for said terminal portions, said insulation displacement blades of said terminals are bent along said partition, said insulation displacement blades are bent toward said insertion opening for said cable holder.

11. A splice absorbing structure for a motor vehicle according to claim 10, wherein the terminal portions are forked terminal portions.

12. A splice absorbing structure for a motor vehicle comprising:

a cable holder for containing ends of a plurality of cables in an aligned state;

a sub connector having insulation displacement terminals having a plurality of insulation displacement blades in an aligned state, said sub connector including a cable holder containing section adapted to accommodate said cable holder, said cables being connected to said insulation displacement blades when said cable holder is fitted into said cable holder containing sections;

a joint connector housing that has a partition standing on a bottom wall in the interior and sub connector containing sections each including an upper opening for containing said sub connector; and a joint bus bar having a plurality of terminal portions, wherein a continuous base portion of said joint bus bar is secured to said bottom wall, said terminal portions stand on said continuous base portion at a given distance spaced away from each other and project toward said sub connector containing sections; and wherein said terminal portions project into said sub connectors so as to be connected to said terminals when said sub connectors are fitted into said sub connector containing sections.

13. A splice absorbing structure for a motor vehicle according to claim 12, wherein the terminal portions are forked terminal portions.

* * * * *